United States Patent [19]

Tamai et al.

[11] 4,096,316

[45] Jun. 20, 1978

[54] METHOD OF PRODUCING MAGNETIC MATERIAL WITH ALKALINE BOROHYDRIDES

[75] Inventors: Yasuo Tamai; Masashi Aonuma, both of Odawara, Japan

[73] Assignee: Fuji Photo Film Co., Ltd., Minami-ashigara, Japan

[21] Appl. No.: 772,896

[22] Filed: Feb. 28, 1977

Related U.S. Application Data

[63] Continuation of Ser. No. 498,338, Aug. 19, 1974, abandoned.

[30] Foreign Application Priority Data

Aug. 18, 1973 Japan ..... 48-92720

[51] Int. Cl.[2] ..... H01F 1/02

[52] U.S. Cl. ..... 428/457; 75/0.5 AA; 148/105; 148/108; 252/62.54; 428/458; 428/461; 428/464

[58] Field of Search ..... 75/0.5 AA; 148/103, 148/105, 108; 252/62.55, 62.54; 427/128, 132; 428/457, 458, 461

[56] References Cited

U.S. PATENT DOCUMENTS

| | | | |
|---|---|---|---|
| 3,206,338 | 9/1965 | Miller et al. | 148/105 |
| 3,494,760 | 2/1970 | Ginder | 75/0.5 AA |
| 3,669,643 | 6/1972 | Bagley et al. | 75/0.5 AA |
| 3,726,664 | 4/1973 | Parker et al. | 75/0.5 AA |
| 3,821,025 | 6/1974 | Akashi et al. | 252/62.54 |
| 3,943,012 | 3/1976 | Tamai et al. | 148/105 |

*Primary Examiner*—Walter R. Satterfield
*Attorney, Agent, or Firm*—Sughrue, Rothwell, Mion, Zinn and Macpeak

[57] ABSTRACT

A method of producing a magnetic material comprising reducing in a solution of a salt of a metal capable of forming a ferromagnetic material with a reducing agent comprising at least one of a borohydride and a derivative thereof, in a solution containing a hydroxide ion concentration of at least about 0.001N and not higher than about 0.6N.

6 Claims, No Drawings

METHOD OF PRODUCING MAGNETIC MATERIAL WITH ALKALINE BOROHYDRIDES

This is a continuation, of application Ser. No. 498,338, filed Aug. 19, 1974, and now abandoned.

BACKGROUND OF THE INVENTION

1. Field of the Invention

This invention relates to a method of producing a magnetic material for use in a magnetic recording medium and, in particular, to a new metal powder magnetic material and a method for the production thereof.

2. Description of the Prior Art

Conventionally, powdered ferromagnetic materials such as $\gamma$-$Fe_2O_3$, $Fe_3O_4$, Co containing $\gamma$-$Fe_2O_3$, Co containing $Fe_3O_4$, $CrO_2$, etc., have been used for magnetic recording media. Such materials, however, are not completely satisfactory for recording signals with short wave-lengths (about 10 microns or less). In other words, their magnetic properties of coercive force ($H_c$) and maximum residual magnetic flux density ($B_r$) are insufficient. Recently, various ferromagnetic powder materials suitable for high density recording have been extensively developed. One group of such materials is a finely divided ferromagnetic metal, comprising pure metal, a metal alloy or an intermetallic compound. Suitable metals include Fe, Co, and Ni, to which, depending on the requirements, Cr, Mn, rare earth metals, Zn, etc., are added.

The following methods of producing ferromagnetic materials are known.

(I) Hydrolysis of an organic acid salt of a ferromagnetic metal, followed by reduction with a reducing gas, as is described in, for example, Japanese Patent Publication Nos. 11412/1961 and 38417/1972.

(II) Reduction of needle-shaped iron oxyhydroxide, needle-shaped iron oxyhydroxide containing a foreign metal, or needle-shaped iron oxide obtained from these oxy-hydroxides, as is disclosed in Japanese Patent Publication Nos. 3862/1960 and 39477/1972, or in British Patent No. 1,192,167.

(III) Vaporization of a ferromagnetic material in an atmosphere of an inert gas, as is described in Japanese Patent Publication No. 27718/1972, or "Ohyo Butsuri" (Applied Physics) Vol. 40, No. 1, p. 110 (19671).

(IV) Decomposition of a metal carbonyl compound, as is described in U.S. Pat. Nos. 2,983,997 and 3,228,882.

(V) Electrodeposition of a ferromagnetic metal onto a mercury cathode, followed by separation of the metal from the mercury, as is disclosed in Japanese Patent Publication Nos. 15525/1964 and 8123/1965.

(VI) Reduction of a salt of a ferromagnetic metal in solution, as is described in Japanese Patent Publication Nos. 20520/1963, 26555/1963, 20116/1968 and 41718/1972, U.S. Pat. Nos. 3,663,318 and 3,661,556, and German Patent OLS 2,132,430.

The present invention relates to method (VI) above and especially to a method which employs a borohydride compound or a derivative thereof as a reducing agent.

Conventional methods of reducing a ferromagnetic metal salt in solution with a borohydride compound or a derivative thereof, have the following drawbacks. Firstly, the metal powder thus prepared, especially when the powder contains Fe, is sensitive to moisture so that it is gradually oxidized even when kept at room temperature conditions. In an extreme case, it has been proved that the ferromagnetic powder is finally converted into a non-magnetic material. Secondly, because of the high surface activity of the powder prepared by this method, the treatment of the powder during production has been quite difficult from an industrial standpoint. That is, a danger of fire exists when such powder is treated in the air; moreover, this active powder tends to decompose or degrade a binder material when blended therewith, thus causing poor dispersion or difficulties in coating.

SUMMARY OF THE INVENTION

A principal object of the present invention is to overcome these drawbacks of the prior art.

An object of the present invention is to provide finely divided magnetic materials having improved magnetic properties.

Another object of the present invention is to provide a new method of producing finely divided magnetic materials which are highly resistant to humidity and also withstand oxidation.

Still a further object of the present invention is to provide a magnetic material which is stable during production and is thus easy to manufacture.

A method of producing a weather-resistant, stable ferromagnetic metal powder has been found involving dissolving a borohydride compound or a derivative thereof in a solution containing an alkali hydroxide and using the resulting solution as a reducing agent.

Thus the present invention provides a method of producing a ferromagnetic material comprising reducing a solution of a salt of a metal capable of forming a ferromagnetic material using as a reducing agent an alkaline solution of a borohydride or a derivative thereof containing hydroxide ion in a concentration of at least about 0.001N and not higher than about 0.6N.

DETAILED DESCRIPTION OF THE INVENTION

Suitable reducing agents for the present invention include borohydrides and derivatives thereof such as borane, borazane, borohydride, sodium borohydride, potassium borohydride, dimethylaminoborane, diethylaminoborane, etc. These reducing agents can be used individually or in combination. These compounds are compounds which contain boron and are water-soluble. Upon reaction hydrogen and metal powder are produced.

In the past, when a ferromagnetic metal powder was prepared through a reducing reaction with a borohydride compound, the borohydride reducing agent was supplied to the reaction in the form of a powder or of an aqueous solution. It has been found, however, that the resulting ferromagnetic powder has improved weather resistance if such a reducing agent is fed to the reaction after dissolution in hydroxide ion containing solution.

The alkaline materials which can be suitably used in the present invention include those compounds which are water-soluble, produce hydroxide ions, and generate a pH of greater than about 8 when dissolved in water. Suitable specific examples include inorganic alkaline materials, e.g., alkali metal hydroxides such as sodium hydroxide, potassium hydroxide, or lithium hydroxide, alkaline earth metal hydroxides such as calcium hydroxide, or barium hydroxide, ammonium hydroxide, and mixtures thereof and organic alkaline materials such as n-butylamine, isopropylamine, hydrazine, etc. These alkaline materials are dissolved in water, or mixtures containing water-miscible organic solvents in an amount of less than about 50% by weight, preferably less than 25% by weight. Suitable water-miscible organic solvents are alcohols such as methanol, ethanol, propanol, butanol; ketones such as acetone, methyl ethyl ketone, dimethyl sulfoxide, tetrahydrofuran, etc. The hydroxide ion containing solution should have a concentration not lower than 0.001N. At concentrations lower than this the advantageous effect of the present invention is not obtained satisfactorily. On the other hand, a concentration above 0.6N is not preferred since with such an extremely strongly alkaline solution the hydroxide or oxy-hydroxide tends to contaminate the resulting ferromagnetic powder.

The mechanism is not clear on why the ferromagnetic powder has a decreased surface activity and thus improved weather resistance by the use of the reducing agent in an alkaline hydroxide solution. However, the property change of the resulting powder surface suggests the formation of a thin oxide or hydroxide layer on the ferromagnetic metal powder surface, and this layer is believed to play the role of a protective coating.

The "metal salt capable of providing a ferromagnetic material" of the present invention includes those materials which contain at least one of Fe, Co, Fe-Co, Fe-Ni, Fe-Co-Ni, or Co-Ni, which can, for the purpose of improvement of the magnetic properties as well as oxidation resistance, contain a suitable amount of a rare earth metal element such as La, Ce, Nd, Sm, etc., or Sn, Al, W, Cr, Mn, Cu, Zn, Ag, Pd, Ti etc. More precisely, the metal salt is a water-soluble salt producing in solution a metal ion or a hydrated metal ion such as the chloride, sulfate, nitrate, formate, acetate, pyrophosphate, sulfamate, etc. of such a metal element.

In addition to the above-described ingredients, a chelating agent which is water-soluble and forms a complex ion with one of the above-described metal ions, a pH buffering agent, a pH controlling agent, etc., can be added to the metal salt solution, e.g., in an amount of less than about 20% by weight, preferably less than 12% by weight, as required. pH buffering agents which also act as chelating agents include monocarboxylic acids such as formic acid, acetic acid, propionic acid, butyric acid, n-valeric acid, acrylic acid, trimethylacetic acid, benzoic acid, chloroacetic acid, etc. and their salts; chelating agents include dicarboxylic acids such as oxalic, succinic, malonic, maleic, itaconic, p-phthalic, etc., and their salts, and oxycarboxylic acids such as glycolic, lactic, salicylic, tartaric, citric, etc. and their salts, pH controlling agents which can also act as pH buffering agents include boric acid, carbonic acid, sulfinic acid, etc., and pH controlling agents include other inorganic and organic acids, ammonia, an alkaline hydroxide, etc. It should be noted that each compound described above not only functions individually but gives rise to interactions. Certain compounds, for example, act as chelating agents as well as pH bufferring agents. Thus, the functions of these compounds need not be limited to those described above.

Further, to the reaction solution there can be added as desired a soluble protein together with a proteolytic enzyme, a carbohydrate together with a carbohydrate decomposer, and an organic solvent, e.g., in an amount less than about 10% by weight, preferably less than about 6% by weight.

Suitable soluble proteins include simple proteins which decompose into chiefly amino acids upon hydrolysis, conjugated proteins comprising polypeptide chains connected to other compounds, derived proteins which have been modified by various physical, thermal, photochemical or chemical procedures, etc. They are all composed of macromolecules of polypeptides, comprising amino acids, having a molecular weight of from about 10,000 to about 5,000,000.

Simple proteins suited for the present invention include albumins such as egg albumin, blood serum albumin, lactoalbumin, etc., globulins such as serum globulin, lactoglobulin, myosin, edestin, ammandin, legumin, etc., glutelins such as glutenin, hordenin, oryzenin, etc., prolamins such as gliadin, hordein, zein, etc., albuminoids such as collagen, elastin, keratin, fibroin, etc., histones such as thymus-histone, liver-histone, scombrone, etc., and protamines such as salmine, clupeine, strurine, iridine, etc.

Conjugated proteins include chromoproteins, phosphoproteins, metalloproteins, lipoproteins, glycoproteins, nucleoproteins, etc. Examples of chromoproteins are hemoproteins such as hemoglobin, myoglobin, cytochrome, catalase, peroxydaze, etc., chlorophyll proteins such as chlorophylin; carotinoid proteins such as rhodopsin, etc., flavoproteins such as flavin mononucleotide, flavin adeninedinucleotide, etc. Phosphoproteins include casein, hyderin, apoferritin, etc. Metalloproteins include iron proteins such as ferritin, apoferritin, etc., copper proteins such as hemocyanine, etc., zinc proteins; manganese proteins, etc. Lipoproteins include thrombplastein, $\alpha_1$-lipoprotein, $\alpha_2$-lipoprotein, lipobilitein, lipotenilin, etc., glucoproteins include mucin, celluloplasmin, siderophilin, fibrin, prothrombin collagen, enterokinase, haptoglobin, mucoid, etc., and nucleoproteins include nucleic acids, deoxypentose-nucleoprotein, pentose-nucleoprotein, viruses, bacteriophages, etc.

Derived proteins include gelatin modified protein, proteans, proteoses, peptones, polypeptides, metaproteins, etc.

These proteins can be used individually or in combination.

To decompose any of these proteins, proteases belonging to the hydrolase type can be employed, including pepsin, trypsin, chymotrypsin, cathepsin, rennin, papain, promelin, ficin, thrombin, enteropeptidase, plasmin, mold protease, yeast protease, bacterium protease, etc. Such proteolytic enzymes can be used individually or in combination.

Carbohydrates comprise monosaccharides, oligosaccharides such as di-, tri- or tetrasaccharides and polysaccharides.

Monosaccharides include polyhydric alcohols containing aldehyde groups (aldoses) and those containing keto groups (ketoses).

Oligosaccharides comprise dimers, trimers or tetramers of monosaccharides, each of which may be common or different, through glycoside linkages. Polysaccharides are polymers of mono- or oligosaccharides.

Suitable monosaccharides include glycol aldehydes which is the aldose of a diose ($C_2H_4O_2$), a triose ($C_3H_6O_3$) such as glyceraldehyde (aldose) or dihydroxyacetone (ketose), etc. a tetrose ($C_4H_8O_4$) such as erythrose (aldose), erythrulose (ketose), etc., a pentose ($C_5H_{10}O_5$) such as ribose, xylose, arabinose (aldose), arabinulose (ketose), xylulose (ketose), etc. a hexose ($C_6H_{12}O_6$) such as D-glucose, mannose, galactose, (aldose), D-fructose, sorbose (ketose), and a heptose ($C_7H_{14}O_7$) such as mannoheptose, which is an aldose, or heptulose which is a ketose.

Oligosaccharides, include disaccharides such as lactose (comprising D-glucose and D-galactose), maltose (comprising two moles of D-glucose), sucrose (comprising D-glucose and D-fructose), trehalose (comprising D-glucose); trisaccharides such as raffinose (comprising D-glucose, D-fructose and D-galactose), gentianose (comprising D-fructose and two molecules of D-glucose), mannotriose (the trimer of mannose), etc; and tetrasaccharides such as stachyose (comprising two molecules of D-galactose, D-glucose and D-fructose), etc.

Polysaccharides which can be used for the present invention include dextrin (D-glucose), starch (D-glucose), glycogen (D-glucose), cellulose (D-glucose), inulin (fructose), mannan (mannose), araban (arabinose), xylan (xylose), dextran (D-glucose), galactan (galactose), gum arabic (comprising galactose, glucuronic acid, hexose and methylpentose), etc.

As is clear from the above explanations, suitable carbohydrates for the present invention are monosaccharides and polysaccharides comprising a multiplicity of monosaccharides connected by glycoside linkages. Further, as the enzyme to decompose such a carbohydrate, a hydrolase such as $\alpha$-amylase (diastase), $\beta$-amylase (diastase), cellulose, lichenase, laminarinase, inulase, $\alpha$-glucosidase, $\beta$-glucosidase, $\alpha$-galactosidase, $\beta$-mannosidase, etc., all of which are glycosidases, can be used.

An inorganic acid such as hydrogen chloride, sulfuric acid, nitric acid, etc. can also be used to decompose carbohydrates.

Ultrasonic waves can be effectively used during the reducing reaction to improve the properties of the resulting material.

The application of a magnetic field to the reaction solution during the reducing reaction results in a remarkable improvement of coercive force and squareness ratio. A higher field strength is preferred, especially of from about 500 to 3,000 Oe, althrough a field stronger than several tens of Oe can be effectively used. A reaction temperature not higher than about 65° C is desirable for a reducing reaction utilizing a borohydride compound. A suitable reaction temperature can range from about −10° to about 65° C. At a temperature above 65° C, the characteristics of the magnetic powder produced deteriorate and at temperatures less than about −10° C, the reactivity is reduced and the solution tends to freeze.

A preferred metal ion concentration range between about 0.002 and 2 mol/l, and more preferably between 0.01 and 0.5 mol/l.

The concentration of the borohydride compound or a derivative thereof reducing agent ranges between about 0.0001 to 15 mol/l, preferably 0.0002 and 10 mol/l. In addition, a desirable result is obtained when the reaction is carried out with a mol ratio of the reducing agent to the metal ion of from about 0.1 : 1 to 5 : 1, preferably 0.25 : 1 to 4 : 1.

The ferromagnetic powder obtained by the present invention exists in a particulate form of a size of from about 50 to 1,000 A with the tendency to form filaments, rods, sticks or a necklace-like structure comprising several to several tens of particles.

The ferromagnetic powder of the present invention exhibits still further improved magnetic properties when heat treated for about 15 seconds to about 120 hours, preferably 3 minutes to 24 hours, at a temperature of about 120° C to 450° C preferably 150° C to 370° C under a non-oxidizing atmosphere or in the presence of a trace of water or of $O_2$. Suitable non-oxidizing atmospheres include inert gases such as helium, neon, argon, krypton, xenon, etc., and gases such as nitrogen, carbon monoxide, carbon dioxide, etc. Where oxygen is present a suitable oxygen concentration is less than about 50 mm Hg, preferably is less than 20 mm Hg, and a suitable amount of water is a relative humidity of less than about 10%.

The ferromagnetic material obtained by the present invention contains a trace of boron, which may originate from the boron hydride compound used as the raw material. Chemical analysis establishes that the boron content ranges from about 2.0 to 10.5%.

The ferromagnetic material of the present invention can be combined with various materials to prepare recording media.

Binder materials which can be used in combination with the ferromagnetic material of the present invention include thermoplastic or thermosetting resins known in the art.

Thermoplastic resins are those with a softening temperature not higher than about 150° C, an average molecular weight of from about 10,000 to 200,000 and with a degree of polymerization of from about 300 to 1,000, including, e.g., vinyl chloride/vinyl acetate copolymers, vinyl chloride/vinylidene chloride copolymers, vinyl chloride/acrylonitrile copolymers, acrylic acid ester/acrylonitrile copolymers, acrylic acid ester/vinylidene chloride copolymers, acrylic acid ester/styrene copolymers, methacrylic acid ester/acrylonitrile copolymers, methacrylic acid ester/vinylidene chloride copolymers, methacrylic acid ester/styrene copolymers urethane elastomers, polyvinylidene fluoride, vinylidene chloride/acrylonitrile copolymers, butadiene/acrylonitrile copolymers, polyamides, poly(vinylbutyral), cellulose derivatives such as cellulose acetate butyrate, cellulose diacetate, cellulose triacetate, cellulose propionate, nitrocellulose, etc., styrene/butadiene copolymers, polyester resins, chlorovinylether/acrylic acid ester copolymers, amino resins, various synthetic rubber based thermoplastic resins, and mixtures thereof.

Use of these resins is described in the following Japanese Patent Publication Nos. 6877/1962, 12528/1964, 19282/1964, 5349/1965, 20907/1965, 9463/1966, 14059/1966, 16985/1966, 6428/1967, 11621/1967, 4623/1968, 15206/1968, 2889/1969, 17947/1969, 18232/1969, 14020/1970, 14500/1970, 18573/1972, 22063/1972, 22064/1972, 22068/1972, 22069/1972 22070/1972 and 27886/1972, and U.S. Pat. Nos. 3,144,352, 3,419,420, 3,499,789 and 3,713,887, etc.

Suitable thermosetting resins which can be used are those which have a molecular weight not greater than about 200,000 when present in the coating mixture, and which form a network with an infinite molecular weight through a condensation or addition reaction. Further those which do not soften or melt until thermal decomposition are preferred. Specific examples are phenol resins, epoxy resins, curable polyurethane resins, melamine resins, urea resins, alkyd resins, silicone resins, reactive acrylic resins, epoxy-polyamide resins, nitrocellulose-melamine resins, mixtures of a high molecular weight polyester resin with an isocyanate prepolymer, mixtures of methacrylic acid ester copolymers with diisocyanate prepolymers, mixtures of polyester polyols with polyisocyanates, urea-formaldehyde resins, low molecular weight glycol/high molecular weight diol-triphenylmethane triisocyanate mixtures, polyamide resins, and mixtures thereof.

Use of these resins is described in the following Japanese Patent Publication Nos. 8103/1964, 9779/1965, 7192/1966, 8016/1966, 14275/1966, 18179/1967, 12081/1968, 28023/1969, 14501/1970, 24902/1970, 13103/1971, 22065/1972, 22066/1972, 22067/1972, 22072/1972, 22073/1972, 28045/1972, 28048/1972, and 28922/1972, and U.S. Pat. Nos. 3,144,353, 3,320,090, 3,437,510, 3,597,273, 3,781,210 and 3,781,211, etc.

These resin binders can be utilized individually or in combination, and further additives can be employed. The mixing ratio between the ferromagnetic powder and the binder is from about 100 : 10 to 100 : 200 by weight, preferably 100 : 25 to 100 : 120 by weight.

Typical additives are a dispersing agent, a lubricating agent, and an abrasive. Dispersing agents include caprylic acid, caproic acid, lauric acid, myristic acid, palmitic acid, stearic acid, oleic acid, elaidic acid, linoleic acid, linolenic acid, stearolic acid, all of which have from about 12 to 18 carbon atoms with the general formula $R_1COOH$ (in which $R_1$ represents an alkyl group having about 11 to 17 carbon atoms); a fatty acid ester with the general formula $R_2COOR_3$ wherein $R_2$ and $R_3$ each represents an alkyl group of having 1 to about 12 carbon atoms including ethyl acetate, butyl acetate, ethyl propionate, methyl butyrate, ethyl caprylate, propyl laurate, etc.; a metal soap comprising an alkali metal (e.g., sodium, potassium, etc.) or an alkaline earth metal (e.g., magnesium, calcium, etc.) salt of the above-cited fatty acid; lecithin, etc. Further, a higher alcohol having about 12 to 24 carbon atoms such as lauryl alcohol, pentadecyl alcohol, cetyl alcohol, stearyl alcohol, nonadecyl alcohol, etc. and the sulfuric acid ester thereof can be employed. Such a dispersing agent can be incorporated in an amount of from about 1 to 20 parts by weight per 100 parts by weight of the binder.

Suitable lubricants include silicone oil, graphite, molybdenum disulfide, tungsten disulfide, a fatty acid ester comprising a monocarboxylic fatty acid having about 12 to 16 carbon atoms and a monohydric alcohol having about 3 to 12 carbon atoms, a fatty acid ester comprising a monocarboxylic acid with more than about 17 carbon atoms and a monohydric alcohol which will form an ester having about 15 to 28 total carbon atoms. Suitable fatty acid esters include ethyl caprylate, ethyl laurate, propyl myristate, methyl palmitate, ethyl stearate, amyl stearate, ethyl behenate, ethyl oleate, propyl linolate, methyl linolenate, etc. Such a lubricant can be used at from about 0.2 to 20 parts by weight per 100 parts by weight of the binder. Descriptions as to the lubricant can be found in Japanese Patent Publication Nos.23889/1968, and Japanese Patent Application Nos. 28647/1967 and 81543/1968, U.S. Pat. Nos. 3,470,021, 3,492,235, 2,497,411, 3,523,086, 3,625,760, 3,630,772, 3,634,253, 3,647,539 and 3,687,725, *IBM Technical Disclosure Bulletin* Vol. 9, No. 7, Page 779, December 1966, and *ELEKTRONIK* 1961, No. 12, Page 380. etc.

As to the abrasive, those conventionally used abrasives can be used including alumina, fused alumina, silicon carbide, chrome oxide, corundum, synthetic corundum, diamond, synthetic diamond, garnet, emery (main ingredient; corundum and magnetite), etc. A preferable size of such an abrasive ranges from about 0.1 to 2 microns in average. The abrasive can be present in an amount of from about 1 to 20 parts by weight per 100 parts by weight of the binder. Descriptions of abrasives can be found in Japanese Patent Application No. 26749/1973, U.S. Pat. Nos. 3,007,807, 3,041,196, 3,293,066, 3,630,910 and 3,687,725, British Patent No. 1,145,349 and German Patent No. 853,211.

A magnetic recording layer can be formed by dissolving the above described components in a suitable organic solvent system and coating the resulting mixture on a substrate.

The substrate can have a thickness of about 5 to 50 microns, more preferably from 10 to 40 microns, and examples include a polyester such as poly(ethylene terephthalate), a polyolefin such as polypropylene, a cellulose derivative such as cellulose triacetate, cellulose diacetate etc., a polycarbonate, etc.

Suitable methods of coating a magnetic recording layer on a substrate include various coating techniques such as air doctor coating, blade coating, air knife coating, squeeze coating, impregnation coating, reverse roll coating, transfer roll coating, gravure coating, kiss coating, cast coating or spray coating. Other methods can be used and all of these methods are explained in detail in *Coating Engineering,* p. 253–277, Asakura Shoten, Mar. 20, 1971.

Organic solvents which can be used for coating include ketones such as acetone, methyl ethyl ketone, methyl isobutyl ketone, cyclohexanone; alcohols such as methanol, ethanol, propanol, butanol, etc.; esters such as methyl acetate, ethyl acetate, butyl acetate ethyl lactate, glycol acetate monoethylether, etc.; ethers and glycol ethers such as diethyl ether, glycol dimethylether, glycol monoethylether, dioxane, tetrahydrofuran, etc.; aromatic hydrocarbons such as benzene, toluene, xylene, etc.; chlorinated hydrocarbons such as methylene chloride, ethylene chloride, carbon tetrachloride, ethylene chlorohydrin, chloroform, dichlorobenzene, etc., dimethyl sulfoxide, and dimethylformamide. A suitable concentration of the ferromagnetic powder in the coating composition can range from about 150 to 500 g, preferably 200 to 450 g per kg of solvent.

The present invention will be further illustrated in greater detail in the following examples and comparative examples. In will be self-evident to those skilled in the art that the ratios, ingredients in the following formulations, and the order of operations can be modified within the scope of the present invention. Therefore, the present invention is not to be interpreted as being limited to the following examples. All parts, percents and the like are by weight, unless otherwise indicated.

EXAMPLE 1

$FeSO_4 \cdot 7H_2O$ (5.6 kg), $CoCl_2 \cdot 6H_2O$ (1.2 kg), and concentrated hydrochloric acid (50 ml) were dissolved in water to form a 100l solution, which was subjected to a DC magnetic field of 500 Oe and kept at 20° C. On the other hand, a reducing agent solution (20l), which was prepared by dissolving sodium borohydride (1.9 kg), and sodium hydroxide (80 g) in water, was added to the metal salt solution at a rate of 1.2l/sec. Immediately a vigorous reaction took place with the generation of a violet foam.

After the reaction ceased, the black precipitate obtained was thoroughly washed with water and then with acetone. The precipitate was dried in an atmosphere with a humidity below 30% at 25° C. The thus obtained ferromagnetic metal powder exhibited a $B_s$ value of 8600G. Using the powder (designated #P-1), a magnetic coating mixture having the following formulation was prepared.

| | parts |
|---|---|
| Ferromagnetic Powder #P-1 | 300 |
| Polyester Polyol* | 40 |
| Cellulose Proionate | 20 |
| Polyisocyanate** | 20 |
| Chromium dixoide*** | 5 |
| Lecithin | 5 |
| Methyl Ethyl Ketone | 450 |
| Butyl Acetate | 450 |

*A condensate of adipic acid and butanediol, having terminal hydroxy groups and a molecular weight of about 1800.
**An adduct of 3 moles of toluene diisocyanate and 1 mole of trimethylolpropane.
***Average particle size of about 0.25 microns in length and 0.04 microns in width.

This mixture was coated on a 25 micron thick poly(ethylene terephthalate) film to give a 5 micron dry thickness under the application of magnetic field, and then dried by heating. The magnetic recording web thus obtained was supercalendered, and then slit to a ½ inch width to give a video tape, designated #T-1.

EXAMPLE II

Another ferromagnetic powder (#P-2) and another video tape (#T-2) therefrom were obtained following the same procedures as in Example I except that the sodium hydroxide (80 g) was replaced by potassium hydroxide (110 g).

EXAMPLE III

Example I was modified only by replacing the sodium borohydride (1.9 kg) with potassium borohydride (0.3 kg) and sodium borohydride 1.7 kg. The resulting powder (#P-3) was used to prepare a video tape, designated #T-3.

COMPARATIVE EXAMPLE

Sodium hydroxide (80 g) was omitted from the composition used in Example I. Except for this elimination, all of the procedures of the example were exactly followed to give a ferromagnetic powder and a video tape.

It was observed that the reducing solution of the comparative example had a noticeable tendency to generate foam during storage compared with those employed in the foregoing examples, containing the alkaline hydroxide. Actually, where the reducing solution free from alkaline hydroxide was used for the reduction reaction after prolonged storage, a magnetic powder with poor magnetic properties resulted.

The various characteristic values of these magnetic powders are shown in Table I.

Table I (grauss)

| Sample No. | $B_s(1)$* | $B_s(2)$** |
|---|---|---|
| #P-1 | 8600 | 7200 |
| #P-2 | 8200 | 7350 |
| #P-3 | 8540 | 7620 |
| Comparative example | 8800 | 4800 |

*$B_s(1)$ is the value of saturation magnetization before weather-resistance testing.
**$B_s(2)$ is the corresponding value after one week of storage at 45° C, 85% R.H.

This result shows that the magnetic powders prepared in accordance with the present invention have improved weather-resistance. The low initial, $B_s$ value of the comparative example may be attributed to an oxidation which took place during the washing with water and the drying.

The various properties of the video tapes produced are shown in Table II. The measurements were made at a magnetic field of 2000 Oe.

Table II

| Sample No. | $H_c$ | $B_r/B_s$ | Video Recording* Output (dB) |
|---|---|---|---|
| #T-1 | 1080 | 0.80 | −1.2 |
| #T-2 | 1050 | 0.81 | +0.4 |
| #T-3 | 1080 | 0.78 | +0.6 |
| Comparative Example | 1100 | 0.73 | 0.0 |

*Values at biasless recording at $5MH_z$, expressed relatively to the output of the comparative example as the control.

With an alkaline hydroxide concentration below 0.001N or above 0.6N, the desirable effects on weather-resistance disappeared and moreover an adverse effect resulted.

The result shows that the control has a lower sensitivity than the tapes of the present invention in spite of its slightly higher coercive force. This may be due to the low squareness ratio and also to a partial oxidation of the ferromagnetic material during tape production.

While the invention has been described in detail and with reference to specific embodiments thereof, it will be apparent to one skilled in the art that various changes and modifications can be made therein without departing from the spirit and scope thereof.

What is claimed is:

1. A method of producing a magnetic material for a magnetic recording medium comprising:

(a) preparing a solution of a reducing agent selected from the group consisting of borane, borazane, borohydride, sodium borohydride, potassium borohydride, dimethylaminoborane and diethylaminoborane and a hydroxide compound selected from the group consisting of sodium hydroxide, potassium hydroxide, lithium hydroxide, ammonium hydroxide, barium hydroxide and calcium hydroxide; and (b) mixing the solution of step (a) with a solution of metal salts capable of forming a ferromagnetic material mainly comprising a ferromagnetic powder selected from the group consisting of Fe, Co, Fe-Co, Fe-Ni, Fe-Co-Ni and Co-Ni, said salt being a chloride, a sulfate, a nitrate, a formate, an acetate, a pyrophosphate, or a sulfamate;

the concentration of reducing agent in the solution of step (a) being 0.002 to 10 mols per liter, the concentration of hydroxide ion in the solution of step (a) being 0.001 N to 0.6N, the concentration of the metal ions in said metal salt solution being 0.002 to 2 mols per liter and the ratio of borohydride to metal ion being 0.25:1 to 4:1;

mixing step (b) being carried out at −10° C to 65° C and the particle size of the ferromagnetic powder product being 50 to 1000 A.

2. The method as claimed in claim 1, including applying a magnetic field to the solution during the reducing.

3. The method as claimed in claim 1, wherein said solution of a salt of a metal capable of forming a ferromagnetic material further contains at least one salt of a rare earth metal element, Sn, Al, W, Cr, Mn, Cu, Zn, Ag, Pd and Ti.

4. The method as claimed in claim 1, wherein said solution of a salt of a metal capable of forming a ferromagnetic material contains at least one of a chelating agent, a pH buffering agent, a soluble protein together with a proteolytic enzyme, a carbohydrate together with a carbohydrate decomposing agent, and an organic solvent.

5. The method as claimed in claim 1, including heat treating the ferromagnetic material obtained in a non-oxidizing atmosphere or in the presence of an atmosphere containing a small amount of water or oxygen.

6. A magnetic recording medium comprising a support having thereon a magnetic layer comprising the ferromagnetic material produced by the method of claim 1 in a binder.

* * * * *